United States Patent [19]

Sanderson

[11] Patent Number: 4,577,444

[45] Date of Patent: Mar. 25, 1986

[54] CHANGEABLE WALL PANEL STRUCTURE

[76] Inventor: Dewey S. C. Sanderson, 3901 E. 26th Ave., Denver, Colo. 80205

[21] Appl. No.: 529,123

[22] Filed: Sep. 2, 1983

[51] Int. Cl.[4] ..... B44F 7/00

[52] U.S. Cl. ..... 52/311; 52/476; 52/489

[58] Field of Search ..... 52/376, 311, 489, 476, 52/509, 241, 204; 160/201

[56] References Cited

U.S. PATENT DOCUMENTS

| | | | |
|---|---|---|---|
| 2,107,624 | 2/1938 | Berger | 52/476 |
| 3,169,281 | 2/1965 | Clements, Jr. | 52/476 |
| 3,178,776 | 4/1965 | Stansberry | 160/201 X |
| 3,299,594 | 1/1967 | Kellert | 52/476 X |
| 3,440,786 | 4/1969 | Weaver | 52/311 |
| 3,643,395 | 2/1972 | Schuyler | 52/509 |
| 3,744,199 | 7/1973 | Navarre | 52/241 X |
| 4,158,277 | 6/1979 | Krempp et al. | 312/204 X |
| 4,353,193 | 10/1982 | Sanderson | 52/311 |
| 4,382,414 | 5/1983 | Svirklys | 52/489 X |

*Primary Examiner*—John E. Murtagh
*Assistant Examiner*—Kathryn L. Ford
*Attorney, Agent, or Firm*—McDougall, Hersh & Scott

[57] ABSTRACT

A changeable wall structure includes a frame which removably holds a plurality of inner decorative panels having displays on one or both sides. A combination of a shelf, a shelf extension, and a support are selectively secured to the frame by mounting brackets. These brackets include upper, lower and intermediate support brackets which permit the support of panels in upper and lower positions, in intermediate positions, and in rearward positions and forward positions. Decorative panels are employed, and the forward or outer panels can partially or totally conceal one or more of the inner panels from view. Each decorative panel is preferably changeable and reversible.

16 Claims, 8 Drawing Figures

CHANGEABLE WALL PANEL STRUCTURE

BACKGROUND OF THE INVENTION

The present invention relates generally to an improved wall covering and, specifically, to a wall structure for supporting both inner and outer decorative panels to provide a versatile system for interior design. The panels are changeable and can be reversed easily to display a second surface with an alternate color or design. A structure of the general type is disclosed in applicant's Pat. No. 4,353,193.

Conventional wall covering materials, such as paint, tile, wallpaper and paneling, are relatively permanent once applied and, depending on the material selected, can require considerable time and expense to replace. As a result, a consumer usually selects a durable, easy to clean wall covering to maximize useful life and to minimize the need for redecorating.

SUMMARY OF THE INVENTION

The wall-mounted structure described herein is a versatile substitute for standard painted, tiled, papered or paneled walls. The appearance of any wall can be easily and quickly improved through the use of changeable panels. Two decorative panel surfaces can be joined to form a single reversible panel, or a single panel can be used with a different or similar covering laminated on each side. Use of this dual purpose panel reduces the need for additional space to store replacement displays.

The structure is also more versatile than conventional wall display units. Outer panels of various lengths and shapes can be mounted within a frame positioned over a plurality of inner decorative panels to subdivide a vertical wall space. The removal of an outer panel exposes one or more of the inner decorative panels to view. In this manner, the design possibilities and color combinations of the wall display structure are greatly increased. Storage of panels for alternate use is also a feature of the invention.

The invention provides a wall-mounted display structure to substitute for conventional wall coverings. The construction of the invention is highly versatile and the appearance of a wall can be easily and quickly changed. In addition, the wall displays can be replaced inexpensively once the framework of the invention has been installed as a partition or on a wall.

The invention includes a frame which can be attached to a wall or which can form an integral part of a wall. As will be more fully appreciated upon consideration of the following disclosure, the term "frame" is to be broadly construed and can be part of an existing wall, such as a plastered or paneled surface, studding, concrete or any other means capable of support. Mounting means, including upper, lower and intermediate support brackets, retain a combination of a shelf, a shelf extension, and an additional support. These latter elements, in turn, hold, respectively, one or more inner panels and one or more outer panels, securely on the frame. The brackets, at the same time, provide a mechanism for quick release when changing a panel.

The outer panels are held in the frame over the inner decorative panels by the shelf to partially or totally conceal the inner panels from view. Both the inner and outer panels are secured within the frame in a tiered relationship with one panel above another. This construction greatly enhances the design capabilities of the structure and is a versatile aid in interior design.

The shelf extension is particularly suited for supporting a bracket permitting the display of recessed frame art works. At the same time, the shelf extension may serve as the top portion of a storage area for an outer panel not in use.

Where the shelf extension is not used, the additional support used for supporting the inner panels is moved adjacent the shelf. This leaves a space behind the inner panels for storage of large panels. The versatility of the system will thus be apparent.

DETAILED DESCRIPTION OF THE INVENTION

Figure 1:
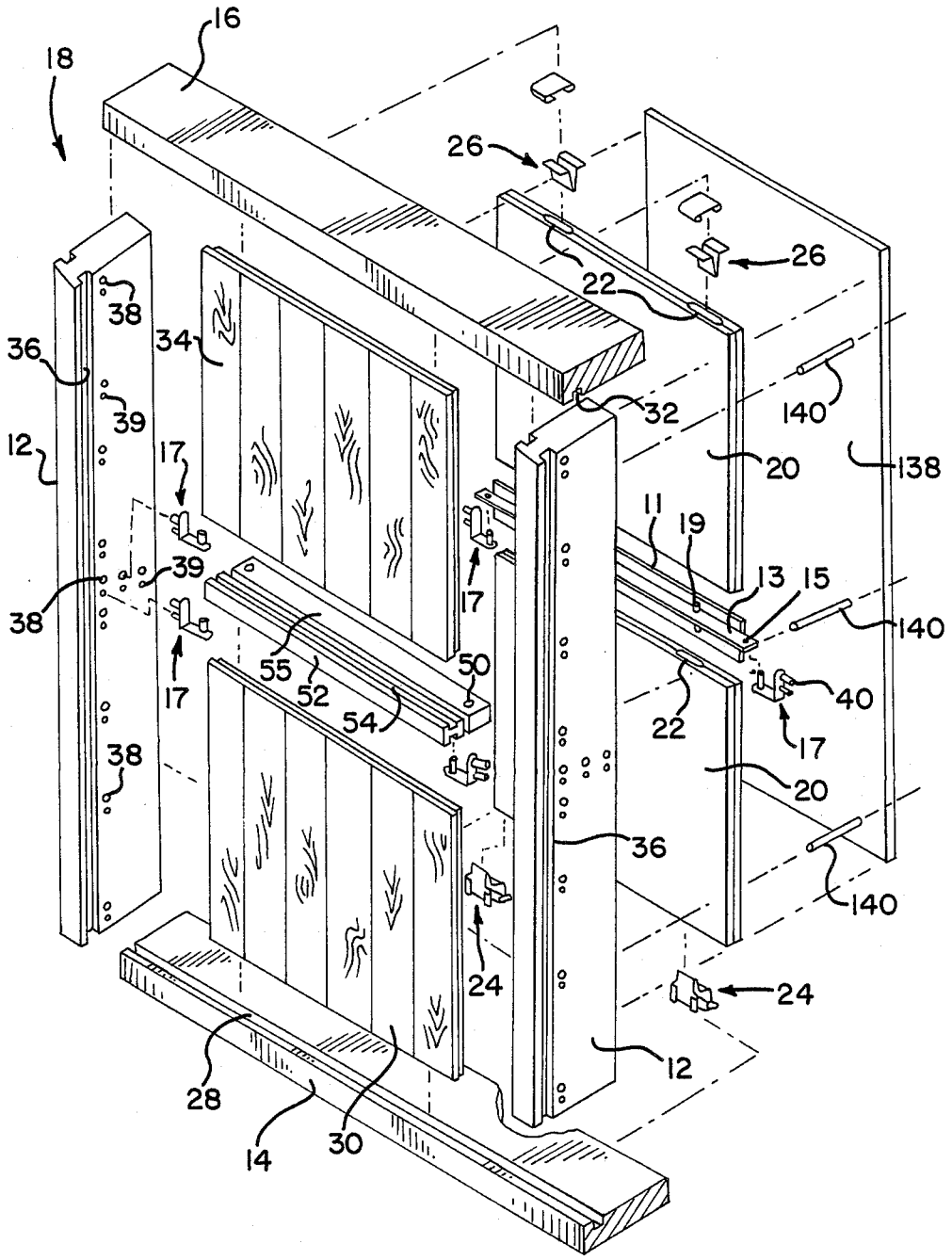
FIG. 1 is an exploded perspective view of the invention.

FIG. 1 is an exploded perspective view which shows the unassembled components of the wall-mounted structure. Side frame sections 12, a lower border member 14 and an upper border member 16 are immovably connected to a wall to define the perimeter of a frame 18. Each side frame section 12 comprises an elongate member positioned between the upper and lower border members which can extend along the width of the wall. The side frame sections and border members can be mounted, of course, to cover less than the entire wall surface in either a lateral or a vertical direction.

The frame 18 can also be constructed as a partition extending perpendicular to an existing wall. Specifically, two frames can be connected back-to-back such that each frame supports the other. In this manner, the joined frames can form a room partition having panels visible from both sides of the structure.

A pair of inner decorative panels 20 are mounted in the frame 18 by a first mounting means comprising at least two lower support brackets 24 connected to the lower border member 14 and at least two upper support brackets 26 connected to the upper border member 16. Slots 22 are defined by the respective upper and lower panel edges for cooperating with the support brackets 24 and 26. These brackets will be described in greater detail with reference to FIGS. 6 and 7, respectively.

A separate support 11 has ends 13 which define holes 15 for receiving the upstanding pins or brackets 17. These brackets are supported on frame section 12. The median support 11 carries upper and lower pins 19 which are adapted to be received in slots 21 defined by adjacent bottom edges of the upper inner panel 20. Both of the inner decorative panels 20 can comprise a pair of wooden sheets which have a texture of the kind frequently used for wood paneling. Each sheet can be made from a different variety of wood so that upon lamination of the sheets, the opposite side of each panel 20 exposes a different surface. With the combination of brackets 24 and 26, and median support 11, alternate wood paneling appearances can be accomplished by releasing a panel and changing the panel position relative its support. The panel surfaces can be revised and they can also be reversed top to bottom.

The decorative panels could be constructed of other materials including glass and plastic; for example, the use of plastic would permit the molding of a wide variety of surface appearances. In addition, drywall or the like could be used. Metal eyelets (not shown) can be inserted in the drywall to receive hooks or screws for hanging objects such as paintings without damaging the drywall.

Coverings for the decorative panels are also contemplated. Wall paper or a similar material can provide one means for achieving a different surface on the panel. Cloth or vinyl coverings with various designs and textures, as well as leather, could be attached. In such cases, the coverings could be replaced particularly if magnetic strips, Velcro, elastic straps, or other attaching means are used to make the coverings easily removable.

The lower border member 14 includes a channel 28 which receives the lower edge of a bottom outer panel 30. Similarly, the upper border member 16 can include a somewhat deeper channel 32 to receive the upper edge of a top outer panel 34. Channels 36 are also provided on each side of the side frame sections 12 to hold the outer panels in a secure relationship within the frame. It will be noted that the provision of such a channel 36 on both sides of the sections 12 contemplates that constructions of the invention can be mounted side-by-side, for example, several such constructions can be used to cover an entire wall.

The side frame sections 12 include holes 38 and 39 which receive protrusions 40 of brackets 17. The support 11 comprises an angle member and when the protrusions 40 are engaged in the appropriate holes 38 and 39 in the side frame sections, the support is secured in position.

Similar brackets 17 have upstanding pins for engaging holes 50 in a shelf 52. Upon positioning a bracket on each inside surface of the frame sections 12, as illustrated in FIG. 1, the hole 50 at each end of the shelf will engage the corresponding pin of bracket 17 to support the shelf and to subdivide a vertical wall space.

The support brackets 17 can be positioned at various points along the inside face of the side frame sections since a plurality of pairs of holes 38 and 39 are provided. In this manner, the area within the frame is partitioned into any number of openings for the insertion of outer panels of various sizes and shapes.

As illustrated, both the top and bottom surfaces of the shelf 52 include a groove 54 for the insertion of a panel edge. In use, the lower and side edges of the bottom outer panel 30 are first inserted into the channels 28 and 36 of the bottom border member 14 and the side frame sections 12, respectively. Brackets 17 are then connected to the side frame sections, as previously described, and the shelf 52 is attached to the brackets so that the lower groove 54 of the shelf receives the top edge of the bottom outer panel 30.

Figures 2, 3, 4, 5:
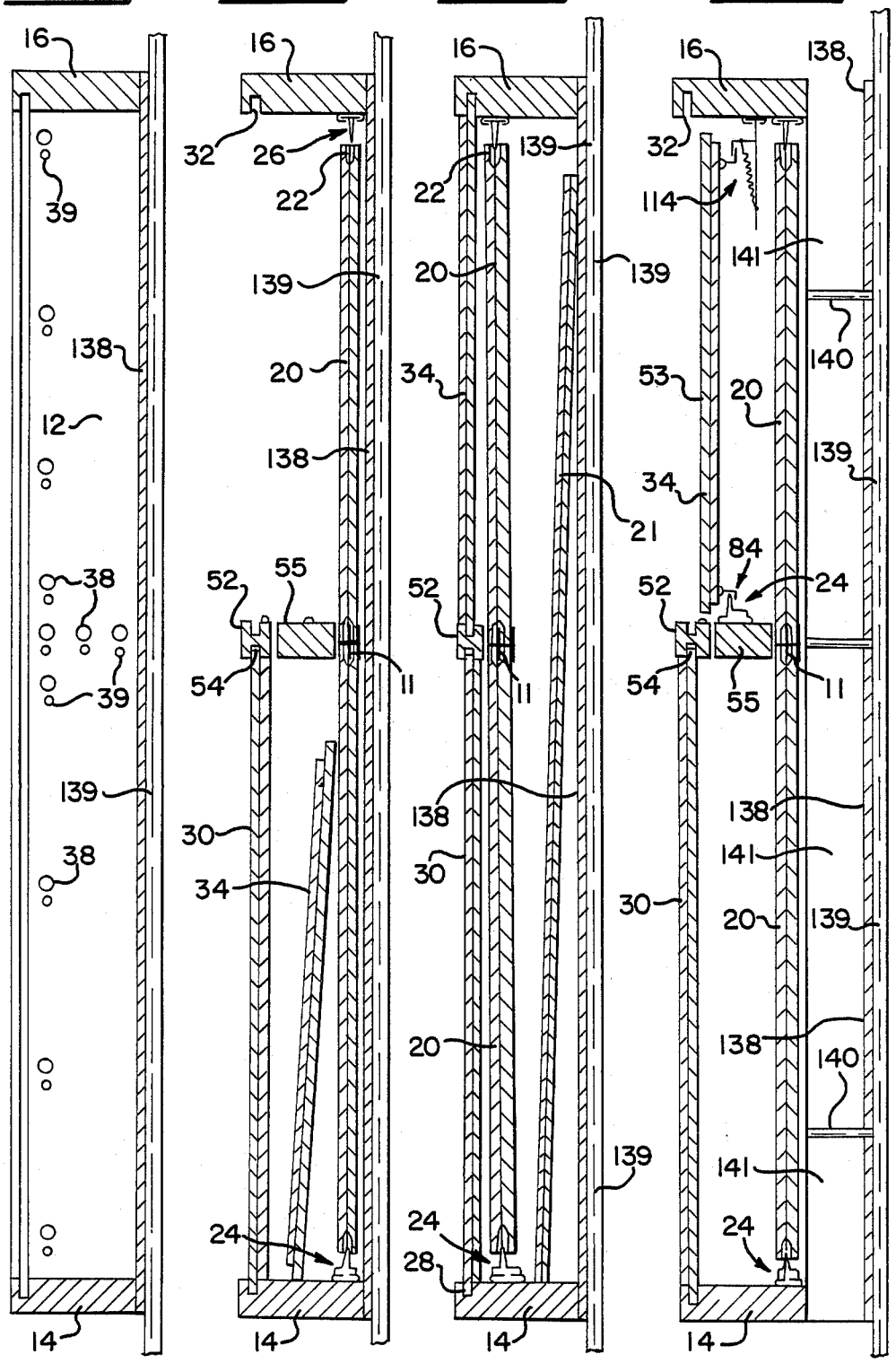
FIG. 2 is a cross-sectional view illustrating a frame portion of the invention.
FIG. 3 is a cross-sectional view showing a shelf, shelf extension, and separate support for holding outer and inner panels in place.
FIG. 4 is a cross-sectional view of the invention with the shelf extension not in use.
FIG. 5 is a cross-sectional view showing use of the invention for supporting framed art.

The top outer panel 34 may be removed and a framed painting 53 installed, and as is apparent from FIG. 5, the removal of either the framed painting or the bottom outer panel 30 will expose an inner decorative panel 20 to view. Once a wall is modified to include a series of adjacent frame sections, the design possibilities are increased and the appearance of the wall can be changed easily.

Figure 6:
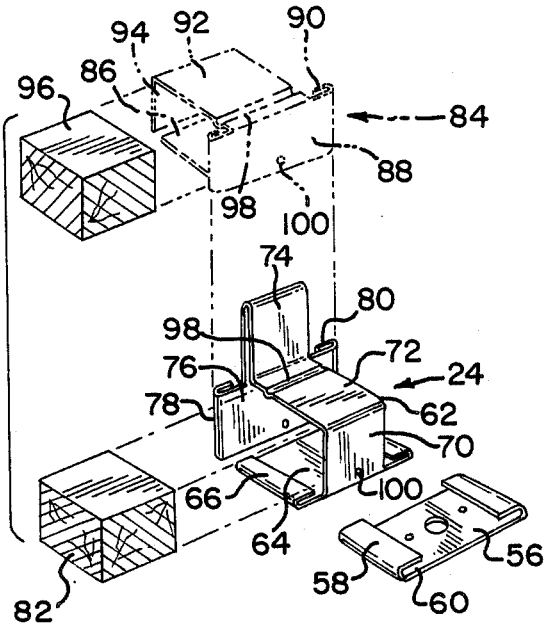
FIG. 6 is a perspective view of a support bracket for a panel.

Referring to FIG. 6, the lower support bracket 24 includes a base plate 56 having a pair of opposed edges 58 rolled upwardly to define a pair of channels 60. The bracket also includes a reinforced member 62 for supporting an inner panel 20. The reinforced member 62 is formed of a sheet metal blank shaped to define a first surface 64 adapted to be positioned co-planar to the base plate 56 in actual use. A pair of opposed edges 66 which are also rolled upwardly so that these edges 64 can be slideably inserted within the channels 60 of the base plate 56.

A second surface 70 extends perpendicularly between the first surface 64 and a third surface 72 which is disposed above and parallel to the first surface 64. The end of the third surface 72 opposite the second surface 70 is reverse folded to form an upwardly extending member 74 which can be received within the slots 22 defined in the bottom edge of lower inner panel 20.

Contiguous with the member 74 is a fourth surface 76 which includes a pair of opposed rolled-over edges 78 forming a pair of channels 80.

As shown in FIG. 6, a block 82 formed of wood or the like can be inserted in the space formed by the surfaces 64, 70, 72 and 76 to strengthen the re-inforced member 62 under the load applied by an inner panel 20.

A second re-inforced member 84 having a first surface 86, a second surface 88 with upwardly rolled, opposed edges 90, a third surface 92 parallel to the first surface 86 and a fourth surface 94 being folded to define a space for the insertion of a block 96 or the like can be connected to the re-inforced member 62 (as indicated by the dotted lines in FIG. 6) to provide additional support for the inner panel.

The third surfaces 72 and 92 of each reinforced member 62 and 84 can include a channel 98 for receiving the lower end of an inner panel 20 stored within the frame 18. Holes 100 are provided in each surface where necessary to receive screws or the like to secure the reinforced member against the frame.

Figure 7:
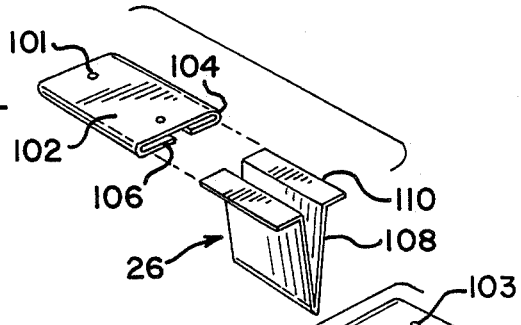
FIG. 7 is a perspective view of upper bracket means for an inner panel.

FIG. 7 shows an upper support bracket 26 which includes a top plate 102 having rolled opposed edges 104 which define a pair of channels 106 and a V-shaped member 108 with outwardly extending co-planar flanges 110 that can be inserted within the channels of the top plate. As shown in FIG. 3, the V-shaped member can be inserted within the upper slots 22 of an upper inner panel 20 to support the panel within the frame 18. Holes 101 are provided for securing the top plate 102 to the upper border member 16 of the frame.

Figure 8:
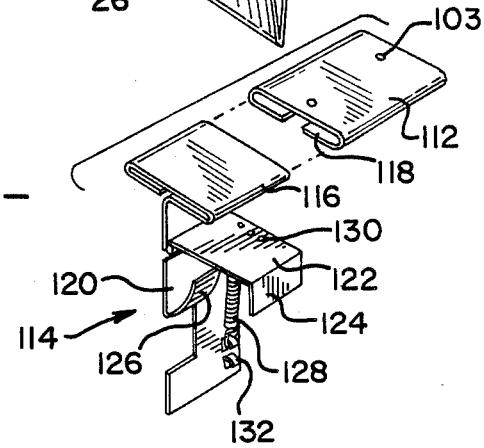
FIG. 8 is a perspective view of a bracket means for mounting framed art, and an extension of installed framed structure from wall to create additional storage space.

Referring to FIG. 8, a means for supporting the upper end of framed art 53 is shown. In this embodiment, a top plate 112 similar to the top plate 102 is used to hold a latch member 114 having an upper portion 116 folded to slide within the channels 118 of the top plate 112. A lower portion 120 extends downwardly and perpendicular to the upper portion 116. Hingeably connected to the lower portion 120 is an L-shaped extension 122, the shorter leg 124 of which can engage a groove, hook or the like at the upper end of framed art 53.

The lower portion 120 also includes a stop member 126 so that when a spring 128 or similar tensioning means is connected between the lower portion 120 and the L-shaped extension 122, the arc through which the L-shaped extension can swing is controlled and the spring remains under tension. The extension, of course, will be swung from its position when the framed art is to be removed.

Holes 103 can, of course, be provided for securing the top plate 112 to the upper border member 16. Also, hole 130 can be provided in the L-shaped extension 122 to receive one end of the spring 128 to control the tension of the latch member 114. Tabs 132 in the lower end of the lower portion 120 provide alternate means for holding the other end of the spring 128.

FIGS. 1 and 5 illustrate wall 139 and insulation 138 with dowels 140 extending between the wall and frame sections 12. This provides a means for locating the structure of the invention in spaced relation to a wall where this is desired for various reasons, for example, as storage space 141 for outer panels. The insulation 138 may comprise heat conservation or sound proofing material, or a combination thereof.

Brackets 17 may be attached to the frame sections 12 for supporting a shelf extension 55. As shown in FIG. 3, this extension serves as a cover for a storage space permitting storage of one or more outer panels.

FIGS. 3 thorugh 5 are particularly helpful for illustrating the versatility of the invention. FIG. 3 illustrates an arrangement where the upper outer panel is removed so that an inner panel surface is displayed. The shelf extension 55 is used so that the removed outer panel, or some other panel or panels can be temporarily stored.

In FIG. 4, the shelf extension 55 has been removed and the inner panel 20 and its support 11 has been moved forward. This provides space behind inner panels 20 for storage of a large outer panel 21.

Panels of other sizes and shapes may also be stored. In this connection, the holes 38 and 39 are located at various levels to support shelf 52 by means of brackets 17, and the brackets may be designed to hold the shelf at an angle to support non-rectangular panels.

FIG. 5 shows use of shelf extension 55 for supporting framed art 53 or the like. This arrangement can, of course, also be employed for supporting a variety of other articles which may only partially obscure the inner panel surface.

It will be understood that other mounting means functioning in the manner described herein could provide suitable alternatives. It will also be understood that changes and modifications may be made in the subject matter described without departing from the spirit of the invention, particularly as described in the following claims.

That which is claimed is:

1. A changeable wall structure comprising a frame including upper, lower and side members, at least one inner panel, a first mounting means connected to said frame for removably holding said inner panel, said first mounting means comprising a bracket including a base plate secured to the lower member of the frame, and a member removably connected to and extending upwardly from said base plate for supporting the lower edge of said inner panel, at least two outer panels mounted one above the other, and second mounting means connected to said frame for removably holding said outer panels to conceal said inner panel, said second mounting means including a bracket secured to each side member of the frame at upper, lower or intermediate levels, and at least one shelf supported at each end by said brackets, grooves defined by the shelf and extending along its upper and lower surfaces for receiving the bottom and top edges, respectively, of said outer panels, said inner and outer panels being removably held so that each panel substantially fills the space between the side members of the frame and wherein, upon removal of an outer panel, the inner panel is exposed to view.

2. A structure in accordance with claim 1 wherein said first mounting means releasably holds said inner panel to permit reversing the panel for display of either side of the panel, and permits removal of the panel for replacement with a different inner panel.

3. A structure in accordance with claim 1 wherein the first mounting means further comprises a member removably suspended from the top member of the frame, said member including an engaging end for supporting the upper edge of said inner panel.

4. A structure in accordance with claim 1 wherein said second mounting means releasably holds said outer panels to permit reversing each outer panel for display of either side of the panel, and permits removal of the panel for replacement with a different outer panel.

5. A structure in accordance with claim 1 wherein said second mounting means further comprises a channel extending upwardly along the interior and exterior surfaces of the side members of the frame for receiving the side edges of said outer panels.

6. A structure in accordance with claim 1 wherein said second mounting means further comprises latch means suspended from the top member of the frame, said latch means including an engaging end for supporting the upper edge of framed art.

7. A structure in accordance with claim 1 comprising a plurality of frame sections in a side-by-side relationship extending over a wall, said inner and outer panels being removably mounted within each frame section.

8. A structure in accordance with claim 1 wherein said base plate includes a pair of rolled opposed edges, each edge forming a channel, and said member includes a lower surface having a pair of rolled opposed edges whereby the edges of the lower surface can be removably inserted within the channels of the base plate.

9. A structure in accordance with claim 1 including a pair of inner panels mounted one above the other, and a median support disposed between said pair of inner panels for engaging the upper edge of the lower inner panel and the lower edge of the upper inner panel.

10. A structure in accordance with claim 1 wherein said inner panel comprises a laminated structure including first and second panel sections, and adhesive means securing said sections together.

11. A structure in accordance with claim 10 including slots formed at the upper and lower edges of the inner panel.

12. A structure in accordance with claim 1 including a shelf extension, a separate bracket secured to each side member for mounting said shelf extension behind said shelf whereby objects can be located on and outer panels stored beneath said shelf extension.

13. A structure in accordance with claim 1 including an insulation panel of material selected from the group consisting of energy-conserving or sound-proofing material, said panel being interposed between the structure and a supporting wall for the structure.

14. A structure in accordance with claim 4 wherein said second mounting means comprise a plurality of sets of holes defined by the side members of the frame for receiving shelf supporting brackets disposed at varying angles for supporting outer panels of various shapes.

15. A structure in accordance with claim 1 comprising means for supporting the inner panels in a forward position for the purpose of storing outer panels behind said inner panels.

16. A structure in accordance with claim 1 comprising a plurality of frames disposed in side-by-side relationship, said frames being mounted in spaced relationship with a support for the frames to provide a storage space for outer panels between the frames and the support.

* * * * *